US007066582B2

(12) United States Patent
Deguchi et al.

(10) Patent No.: US 7,066,582 B2
(45) Date of Patent: Jun. 27, 2006

(54) METHOD FOR PRODUCING ORGANIC INSULATING COATING AND INK-JET PRINTHEAD PRODUCED ACCORDING TO THE METHOD

(75) Inventors: Haruhiko Deguchi, Tenri (JP); Shigeaki Kakiwaki, Nara (JP); Hirotsugu Matoba, Sakurai (JP); Hirokazu Nakamura, Nara (JP); Masaki Matsushita, Ikoma-gun (JP); Tomomi Tanaka, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 163 days.

(21) Appl. No.: 10/637,861

(22) Filed: Aug. 8, 2003

(65) Prior Publication Data

US 2004/0032466 A1 Feb. 19, 2004

(30) Foreign Application Priority Data

Aug. 12, 2002 (JP) ..... P2002-234772

(51) Int. Cl.
*B41J 2/045* (2006.01)
*B41J 2/05* (2006.01)

(52) U.S. Cl. ..... 347/68; 347/64; 347/69

(58) Field of Classification Search ..... 347/44, 347/45, 68–72; 427/77, 384, 388.1
See application file for complete search history.

(56) References Cited

U.S. PATENT DOCUMENTS 5,248,998 A * 9/1993 Ochiai et al. ..... 347/71
6,176,571 B1 * 1/2001 Kishima et al. ..... 347/70
6,715,860 B1 * 4/2004 Watanabe ..... 347/68
6,733,113 B1 * 5/2004 Yoshizawa et al. ..... 347/68
6,802,596 B1 * 10/2004 Higuchi et al. ..... 347/68
M

FOREIGN PATENT DOCUMENTS

| | | | |
|---|---|---|---|
| JP | 11-309856 | | 11/1999 |
| JP | 2000-71451 | * | 3/2000 |
| JP | 2001-096754 | | 4/2001 |
| JP | 2002-210967 | * | 7/2002 |

OTHER PUBLICATIONS

JP-2000-071451 Japanese Publication, (Watanabe) Mar. 7, 2000, online, retrieved on Apr. 12, 2005. Retrieved from the Industrial Property Digital Library of the Japanese Patent Office using the Internet <URL:http://www4.ipdl.ncipi.go.jp/Tokujitu/PAJdetail.ipdl>.*

* cited by examiner

M

*Primary Examiner*—Manish Shah
*Assistant Examiner*—Geoffrey Mruk
(74) *Attorney, Agent, or Firm*—Edwards Angell Palmer & Dodge LLP; David G. Conlin; Mark D. Russett

(57) ABSTRACT

An organic insulating coating formed on a substrate is composed of two layers of a first parylene coating and a second parylene coating. Heat treatment is performed to at least the first parylene coating after being formed, at a temperature below 125° C. for two hours. Then the second parylene coating is formed on the first parylene coating. Occurrence of pinholes is thus prevented at least in one of the two layers of the organic coatings, with the result that insulating properties of the coatings are improved.

16 Claims, 11 Drawing Sheets

| Sample No. | 1st Parylene Coating | Inter-layer Treatment | 2nd Parylene Coating | Post-coating Treatment | Number of Etched Points - 24 Hr Later | Number of Etched Points - 120 Hr Later |
|---|---|---|---|---|---|---|
| #1 | 2 μm | 100 ℃/2H | 2 μm | Undone | 0 | 0 |
| #2 | 4 μm | Undone | — | — | 4 | — |
| #3 | 4 μm | Undone | — | 100 ℃/2H | 2 | — |
| #4 | 4 μm | Undone | — | — | 2 | — |
| #5 | 8 μm | Undone | — | — | 3 | — |
| #6 | 2 μm | Undone | 2 μm | Undone | 2 | — |

FIG. 4

| Sample No. | 1st Parylene Coating | Inter-layer Treatment | 2nd Parylene Coating | Post-coating Treatment | Appearance | Number of Etched Points - 24 Hr Later | Number of Etched Points - 120 Hr Later |
|---|---|---|---|---|---|---|---|
| #11 | 2 μm | 100 ℃/2H | 2 μm | Undone | OK | 0 | 0 |
| #12 | 2 μm | 60 ℃/2H | 2 μm | Undone | OK | 3 | — |
| #13 | 2 μm | 150 ℃/2H | 2 μm | Undone | OK | 0 | 0 |
| #14 | 2 μm | 200 ℃/2H | 2 μm | Undone | OK | 0 | 2 |
| #15 | 2 μm | 250 ℃/2H | — | — | Detached | — | — |

FIG. 6

| Sample No. | 1st Parylene Coating | Inter-layer Treatment | 2nd Parylene Coating | Number of Etched Points - 24 Hr Later | Number of Etched Points - 120 Hr Later | Number of Etched Points - 250 Hr Later |
|---|---|---|---|---|---|---|
| #21 | parylene C/2 μm | 120 ℃/2H | parylene N/2 μm | 0 | 0 | 0 |
| #22 | parylene C/4 μm | Undone | — | 4 | — | — |
| #23 | parylene N/4 μm | Undone | — | 6 | — | — |
| #24 | parylene C/4 μm | 100 ℃/2H | — | 2 | — | — |
| #25 | parylene N/4 μm | 100 ℃/2H | — | 4 | — | — |
| #26 | parylene C/2 μm | Undone | parylene C/2 μm | 2 | — | — |
| #27 | parylene N/2 μm | Undone | parylene N/2 μm | 3 | — | — |
| #28 | parylene C/2 μm | 120 ℃/2H | parylene C/2 μm | 0 | 0 | 2 |
| #29 | parylene N/2 μm | 120 ℃/2H | parylene N/2 μm | 0 | 1 | — |
| #30 | parylene C/2 μm | Undone | parylene N/2 μm | 0 | 0 | 3 |
| #31 | parylene N/2 μm | Undone | parylene C/2 μm | 0 | 2 | — |
| #32 | parylene N/2 μm | 120 ℃/2H | parylene C/2 μm | 0 | 0 | 2 |

FIG. 7

METHOD FOR PRODUCING ORGANIC INSULATING COATING AND INK-JET PRINTHEAD PRODUCED ACCORDING TO THE METHOD

BACKGROUND OF THE INVENTION

1. Technical Field of the Invention

The present invention relates to a method for producing an organic insulating coating such as a protective coating for electrodes in ink chambers of an ink-jet printhead, and further to an ink-jet printhead produced according to the method.

2. Description of Related Art

In place of impact printers, there has been a rapid diffusion of non-impact printers suitable for color and multiple-tone printing such as ink-jet printers. In particular drop-on-demand printers, which eject ink droplets only when needed to print on media, are popular because of their improved printing efficiency and low production and running costs. Most of the drop-on-demand printers today are using a Kyser method utilizing piezoelectric elements or a thermal ink-jet method.

In the Kyser-type printers, however, printheads are difficult to miniaturize and nozzle density thereof is difficult to increase. In the thermal ink-jet printers, although a high nozzle density is obtainable, since the energy of bubbles produced in ink by heating the ink with a heater is used to eject ink droplets, high ink durability is required, long life of the heater is hard to obtain, and power consumption is high.

To solve the foregoing problems, there has been proposed an ink-jet method according to which shear mode deformation of a piezoelectric material is utilized to eject ink. More specifically, an electric field perpendicular to a poling field of the piezoelectric material is applied to electrodes provided on sidewalls of an ink chamber made of the piezoelectric material to deform the sidewalls in shear mode, so that a pressure wave generated by the deformation is utilized to eject ink droplets through nozzle orifices. This method can realize a higher nozzle density, lower power consumption, and a higher drive frequency.

Illustrated in FIG. 11 is a configuration of a shear mode ink-jet printhead. The ink-jet printhead includes a base member 1 made of a piezoelectric material that is poled in the vertical direction to the plane of the drawing, with a plurality of grooves 4 formed on an upper surface thereof, a cover member 2 with an ink feed opening and a common ink chamber 22 provided, and a nozzle plate 9 with nozzle orifices 10. The grooves 4 in the base member 1 are formed into ink chambers 16 by attaching the cover member 2 and the nozzle plate 9 respectively to the upper surface and a lower surface of the base member 1. The ink chambers 16 are separated by sidewalls 3 having electrodes 5 on upper halves of the surfaces thereof for creating an electric field. Formed on the surfaces of the electrodes 5 are insulating coatings, or protective coatings, (not shown) for preventing the electrodes 5 from contacting ink filled in the ink chambers 16 directly.

Rear bottom edges of the ink chambers 16 are formed into an arc of a circle having radius of a dicing blade used to cut the grooves 4. The dicing blade is used to cut shallow grooves 6 as electrode lead parts for electrical conduction with the exterior. The electrodes 5 in the shallow grooves 6 are connected to external electrodes 8, for example on a flexible substrate, at rear ends of the shallow grooves 6.

Used as an insulating coating for preventing the electrodes 5 from contacting the ink is a poly-p-xylylene (known as parylene: "parylene" is a trademark of Nihon Parylene Kabushikikaisha) coating. The poly-p-xylylene coating is made from di-p-xylylene by CVD (chemical vapor deposition) method. Specifically, di-p-xylylene dimer is vaporized and then pyrolyzed to form stable monomeric diradical p-xylylene. The monomer simultaneously absorbs and polymerizes on a substrate to form a high-molecular-weight thin film. Hereinafter referred to as parylene N or poly-p-xylylene is the reaction product of di-p-xylylene dimer as dimeric p-xylylene, and referred to as parylene C or poly-monochloro-p-xylylene is the reaction product of di-p-xylylene dimer as dimeric monochloro-substituted p-xylylene.

Since the poly-p-xylylene coating is chemically stable and less susceptible to damage in an environment where the coating is exposed, the coating maintains constant insulating properties. Also, since the poly-p-xylylene coating is formed at room temperature by vapor phase epitaxy, it is possible to form an uniform insulating coating of the poly-p-xylylene over a substrate whose properties are degraded by heat or whose surface has a complex shape, without thermally damaging the substrate.

However, when the poly-p-xylylene coating is in use as the insulating coating for electrodes in ink chambers of an ink-jet printhead, there occurs a problem as described below.

Although it is possible to form an uniform coating of the poly-p-xylylene in ink chambers of ink-jet printheads having a complex shape, piezoelectric materials such as PZT used in the ink-jet printheads are sintered ceramics, and surfaces on which electrodes are to be formed attains a pear-skin finish with microscopic concavities and convexities because ceramic particles fall out of the surfaces when grooves are cut in there. When a parylene coating is formed over such a pear-skin-finished base, macroscopically a uniform coating is obtained. However, the parylene coating grown with the concavities and convexities of the base reflected has microscopic flaws (pinholes).

Since aqueous ink is an electrolyte solution with a very high electrical conductance in comparison with oil-based ink, if there is a pinhole through an insulating coating separating an electrode and the aqueous ink in an ink chamber, the electrode is electrically conducted with another electrode in an adjacent ink chamber through the ink infiltrating through the pinhole, so that electrolyte corrosion of the electrodes occurs. This causes ink-jet printhead reliability problems such as fluctuations in ink-ejecting properties during operation of an ink-jet printhead and inferiority in ink ejection in the ink-jet printhead caused by breaking of electrode wires. These problems also occur in an organic insulating coating formed over another kind of substrate such as a semiconductor.

To solve the problems, Japanese Laid-open Patent Publication No. 2001-96754 discloses a method for improving insulating properties of a parylene coating, by which after the parylene coating is formed polyimide resin is electrodeposited selectively over a pinhole and then sintered at 80° C. for 24 hours. According to the method, however, equipment is required for the electrodeposition of polyimide resin, thereby increasing production costs. Also, it is necessary to sinter the polyimide resin for a long time, so that production throughput is decreased.

On the other hand, Japanese Laid-open Patent Publication H11-309856 discloses a method for improving insulating properties of parylene coatings, by which coatings of two kinds of parylene having different structures are layered with plasma treatment performed to a lower parylene coating.

According to the method, however, vacuum equipment is required for the plasma treatment, thereby increasing production costs.

An object of the present invention is to provide a method for producing an organic insulating coating which prevents electrolytic corrosion of electrodes by improving insulating properties of the organic insulating coating separating the electrodes from an electrolyte solution, as well as to provide an ink-jet printhead having stable ink-ejecting properties ensured by utilizing the method for producing the organic insulating coating.

SUMMARY OF THE INVENTION

The present invention includes:

- a first coating step of forming a first organic coating on a substrate;
- a second coating step of forming a second organic coating on the first organic coating; and
- at least either one of:
  - a first heat treatment step of treating the first organic coating with heat after the first coating step; and
  - a second heat treatment step of treating the second organic coating with heat after the second coating step.

In this configuration, an organic insulating coating includes at least the two layers of the first organic coating which is formed on the substrate and the second organic coating which is formed on the first coating, with at least either one of the first organic coating and the second organic coating treated with heat. Consequently occurrence of pinholes is prevented in either one of the two layers of organic coatings, such that insulating properties of the organic insulating coating is improved.

The present invention further includes:

- electrodes provided on at least part of interior walls of ink chambers, at least part of the ink chambers made of an piezoelectric material; and
- a protective coating for coating the surfaces of the electrodes, the protective coating formed by:
  - a first coating step of forming a first organic coating on the interior walls of the ink chambers provided with the electrodes;
  - a second coating step of forming a second organic coating on the first organic coating; and
  - at least either one of:
    - a first heat treatment step of treating the first organic coating with heat after the first coating step; and
    - a second heat treatment step of treating the second organic coating with heat after the second coating step.

In this configuration, the protective coating for the electrodes in the ink chambers of an ink-jet printhead includes two or more layers of the organic coatings with at least one of the layers treated with heat. The configuration ensures that the electrodes formed in the ink chambers to be filled with ink are insulated from the ink by the organic coating in which occurrence of pinholes is prevented.

BRIEF DESCRIPTION OF THE DRAWINGS

FIG. 4 is a table illustrating the evaluation result of a sample coating formed according to the method of an embodiment of the present invention in comparison with sample coatings formed according to other production methods;

FIG. 6 is a table illustrating the evaluation results of sample coatings where each organic insulating coating is formed with first organic coating thereof treated with heat at temperatures varying from 60° C. to 250° C.;

FIG. 7 is a table illustrating the evaluation results of sample coatings where each organic insulating coating is formed with the properties of first and second parylene coatings and the heat treatment temperature of the first coating varied;

DESCRIPTION OF THE PREFERRED EMBODIMENTS

Figure 1:
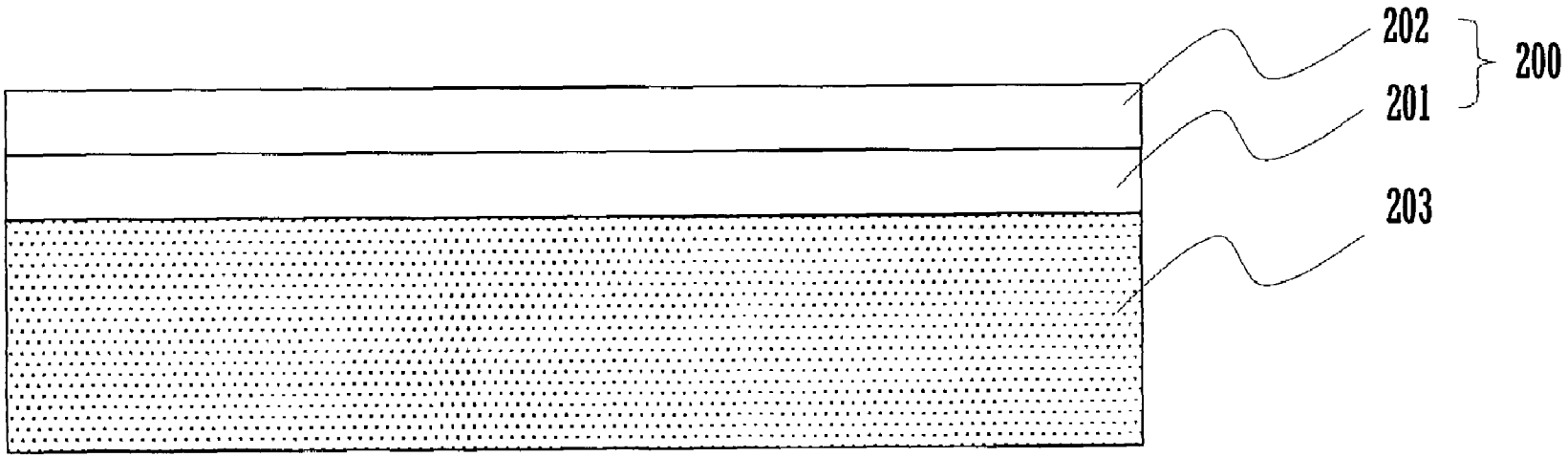
FIG. 1 is a diagram showing a configuration example of an organic insulating coating formed on a substrate according to a method for producing an organic insulating coating of the present invention.

FIG. 1 is a diagram showing a configuration example of an organic insulating coating formed on a substrate according to a method for producing an organic insulating coating of the present invention. An organic insulating coating 200 formed on a surface of a substrate 203 is composed of a first organic coating 201 and a second organic coating 202, each of which is a parylene-based organic coating (hereinafter referred to as a parylene coating) of thickness 2 μm.

Figure 2A:
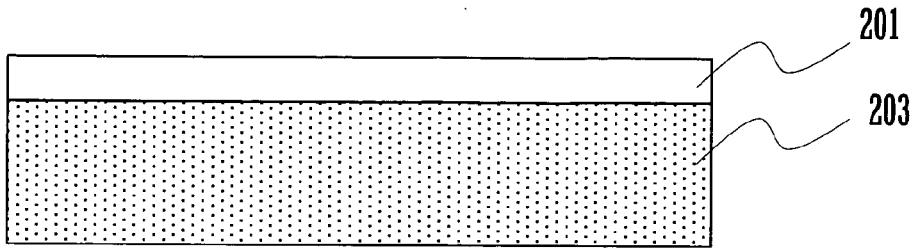
FIGS. 2A to 2C are diagrams illustrating a method for producing the organic insulating coating.
Figure 2B:
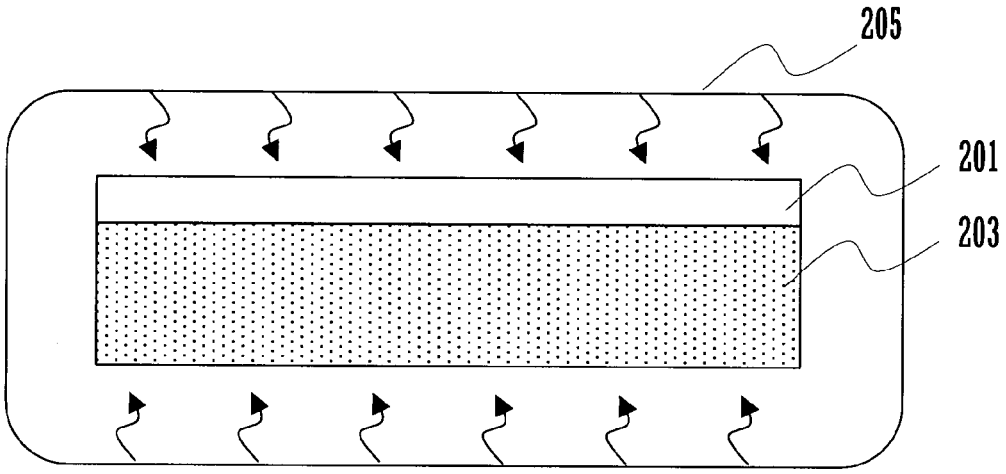
Figure 2C:
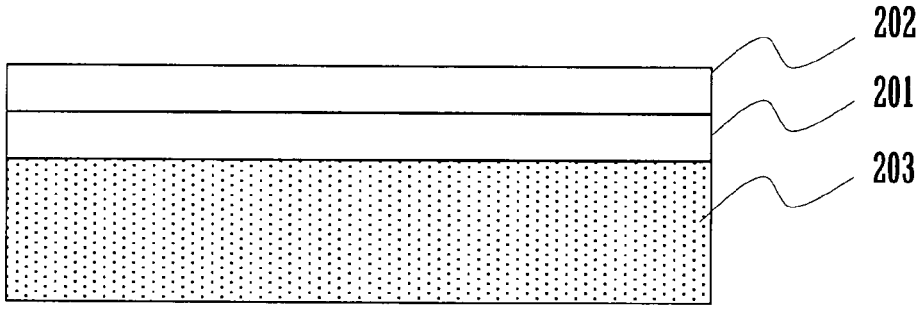

FIGS. 2A to 2C are diagrams illustrating a method for producing the organic insulating coating. When the organic insulating coating 200 is formed on the substrate 203, the parylene coating 201 is first formed to have thickness 2 μm on the substrate 203, as shown in FIG. 2A.

Then, as shown in FIG. 2B, the substrate 203 with the first parylene coating formed thereon is placed in a heating device 205 such as an oven to be heated at 100° C. for two hours in the atmosphere. Although an oven is used for heating the first parylene coating 201 in the present embodiment, a contact-type heating device such as a hot plate may be used to heat the first parylene coating 201 from beneath the substrate 203.

Finally, the second parylene coating 202 is formed on the first parylene coating 201 treated with heat, as shown in FIG. 2C.

Figure 3:
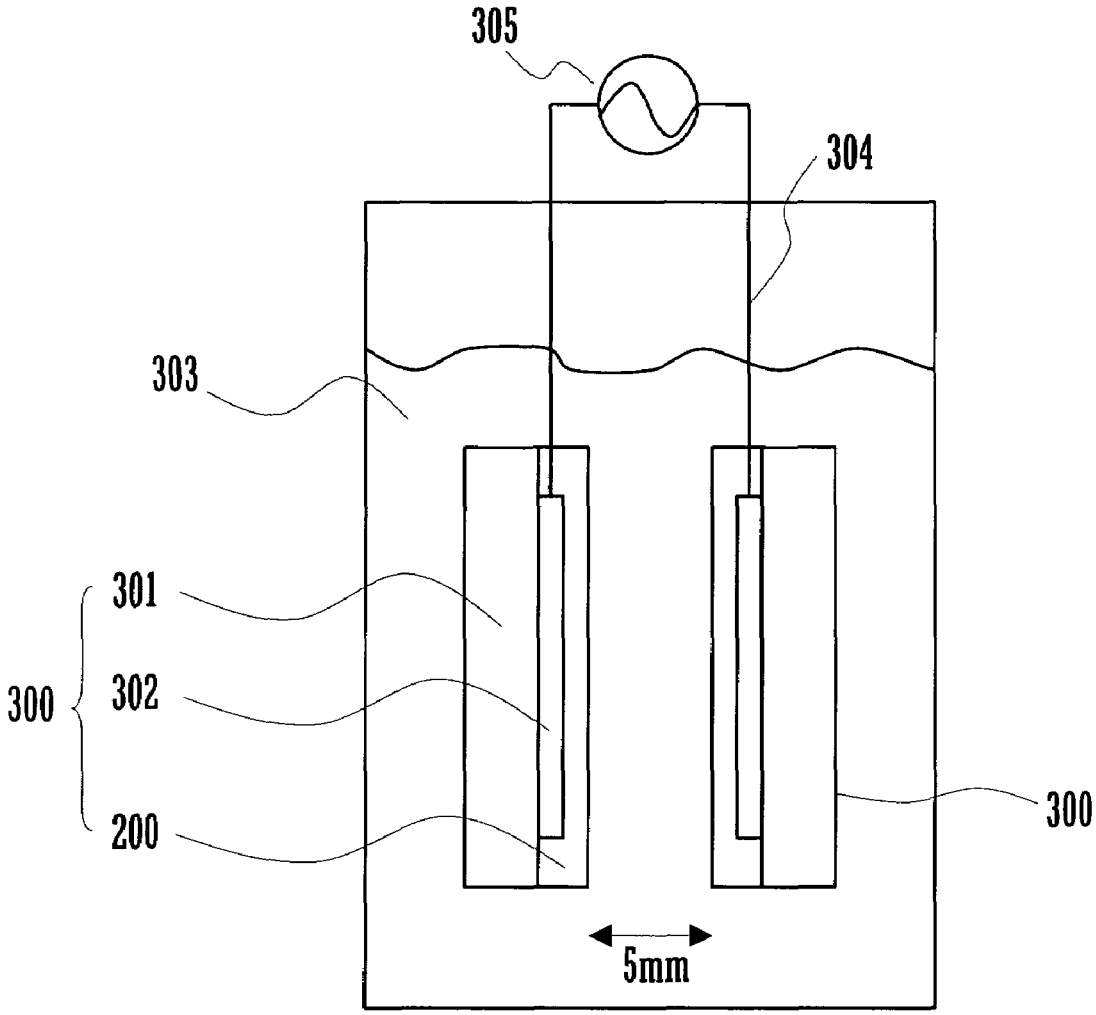
FIG. 3 is a diagram illustrating an evaluation method of insulating properties of the organic insulating coating.

FIG. 3 is a diagram illustrating an evaluation method of insulating properties of the organic insulating coating. The insulating organic coating 200 is formed on a glass substrate 301 with a Cu coating 302 of thickness 0.5 μm. This is hereinafter referred to as a sample coating 300. Two sample coatings 300 are prepared, and dipped in ink 303 whose electrical conductivity is 19.85 S/m so as to face each other at a distance of 5 mm therebetween. Then occurrence of etching caused by pinholes in the Cu coating 302 is examined by connecting the Cu coating 302 in the sample coatings 300 to an AC power supply 305 via wiring 304 of a flexible substrate or the like and applying 90 V alternating current (effective value) at 60 Hz.

FIG. 4 is a table illustrating the evaluation result of a sample coating formed according to the method of an embodiment of the present invention in comparison with sample coatings formed according to other production methods.

In sample #1 the organic insulating coating 200 is formed according to the method of the embodiment of the present invention as shown in FIG. 2.

In comparison sample #2, a parylene coating of thickness 4 μm is formed on the glass substrate 301 having the Cu coating 302.

In comparison sample #3, a parylene coating of thickness 4 μm is formed on the glass substrate 301 having the Cu coating 302 and then processed with heat at 100° C. in the atmosphere for two hours.

In comparison sample #4, a parylene coating of thickness 4 μm is formed on a $SiO_2$ coating of thickness 1 μm formed on the glass substrate 301 having the Cu coating 302.

In comparison sample #5, a parylene coating of thickness 8 μm is formed on the glass substrate 301 having the Cu coating 302.

In comparison sample #6, a parylene coating of thickness 2 μm is formed on a parylene coating of thickness 2 μm formed on the glass substrate 301 having the Cu coating 302.

Figure 5A:
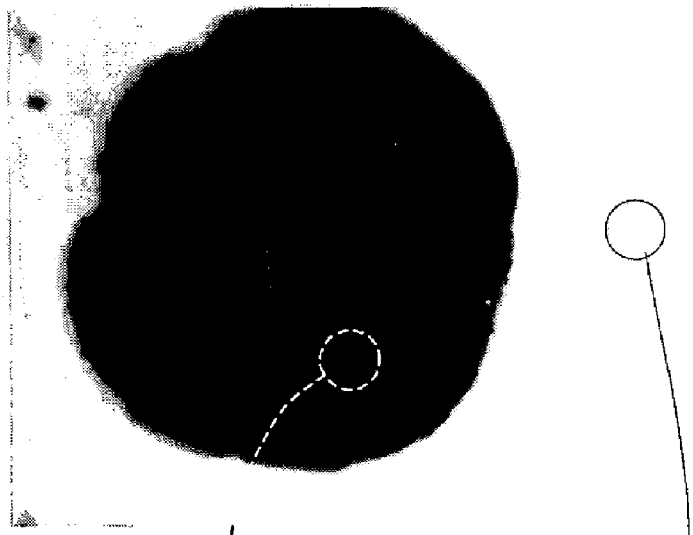
FIG. 5A is an optical microscope photograph of an area on a Cu coating where etching is caused by a pinhole.
Figure 5B:
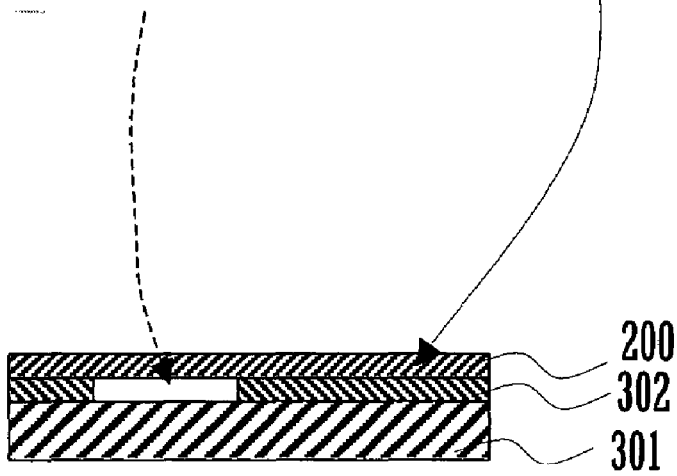
FIG. 5B is a cross-sectional schematic view of the area.

In the comparison samples #2 to #6, etching caused by one or more pinholes is observed on the Cu coating 302 within 24 hours. Illustrated in FIGS. 5A and 5B is an example of pinholes observed in the experiment. FIG. 5A is an optical microscope photograph of an area where etching is caused by a pinhole, and FIG. 5B is a cross-sectional schematic view of the area. A pinhole in the center of the drawings causes the Cu coating 302 to be etched concentrically around the pinhole.

The comparison samples #2 and #5 show that merely increasing the thickness of a parylene coating is less effective in preventing the etching caused by pinholes.

The comparison sample #6 shows that merely forming two layers of parylene coatings of total thickness 4 μm is less effective in preventing the etching caused by pinholes.

The comparison sample #3 shows that heat treatment after the two layers of parylene coatings are formed is less effective.

The comparison sample #4 shows that the layers of the $SiO_2$ coating of thickness 1 μm and the parylene coating of thickness 4 μm are less effective in preventing the etching caused by pinholes.

In the sample #1, by contrast, no pinhole is spotted in an observation after 24 hours, nor after 120 hours. Specifically, two layers of parylene coatings of thickness 4 μm with a lower coating treated with heat at 100° C. for two hours after being formed prevent the electrolytic corrosion of the Cu coating caused by pinholes, thereby increasing the insulating properties of the parylene coating.

FIG. 6 is a table illustrating the evaluation results of sample coatings where each organic insulating coating is formed with first organic coating thereof treated with heat at temperatures varying from 60° C. to 250° C. In each sample, the organic insulating coating 200 of total thickness 4 μm is formed by the first parylene coating 201 and the second parylene coating 202, both of thickness 2 μm, with the first coating 201 treated with heat at a different temperature. More specifically, in samples #11 to #15, the first parylene coatings 201 are treated with heat respectively at 100° C., 60° C., 150° C., 200° C., and 250° C.

In the sample #15 where the first coating 201 is treated at 250° C., the coating 201 is detached from the Cu coating 302, structurally destroyed. In the samples #11 to #14 where the first coatings 201 are treated at temperatures of 200° C. and below, by contrast, the detachment of the coatings 201 is not observed.

Regarding the insulating properties, however, etching of the Cu coating 302 caused by two pinholes is observed after a lapse of 120 hours in the sample #14 where the heat treatment is performed at 200° C. Also, the etching by three pinholes is observed after a lapse of 24 hours in the sample #12 where the heat treatment is performed at 60° C. The sample #6 where the heat treatment is performed at 150° C., by contrast, has no etching observable after a lapse of 120 hours, as in the case of the sample #1, and proves to have good insulating properties.

These results show that effective temperature range for the heat treatment of the first parylene coating 201 is between its glass transition point (87 to 97° C.) and its melting point (250° C.), preferably at and below 150° C. within the range.

FIG. 7 is a table illustrating the evaluation results of sample coatings where each organic insulating coating is formed with the properties of first and second parylene coatings and the heat treatment temperature of the first coating varied.

When an organic insulating coating is formed as a protective coating for electrodes in ink chambers in an ink-jet printhead using mainly aqueous ink, the coating is required to have water-resisting property for keeping the electrodes and the aqueous ink insulated as well as gas impermeability for preventing permeation of gases including water vapor, it being considered that air is mixed in the aqueous ink and the heated ink is vaporized.

There are two variations of parylene: parylene C and parylene N. The parylene C has a high level of gas (including water vapor) impermeability, and the parylene N has high water resistance. The problem is how the parylene C and the parylene N should be used for an organic insulating coating as the protective coating for electrodes in ink chambers in an ink-jet printhead.

In sample #21, a parylene-C coating of thickness 2 μm is formed on the glass substrate 301 having the Cu coating 302, to be treated with heat at 120° C. in the atmosphere for two hours, and then a parylene-N coating of thickness 2 μm is formed on the parylene-C coating.

In comparison sample #22, a parylene-C coating of thickness 4 μm is formed on the glass substrate 301 having the Cu coating 302.

In comparison sample #23, a parylene-N coating of thickness 4 μm is formed on the glass substrate 301 having the Cu coating 302.

In comparison sample #24, a parylene-C coating of thickness 4 μm is formed on the glass substrate 301 having the Cu coating 302 and then treated with heat at 100° C. in the atmosphere for two hours.

In comparison sample #25, a parylene-N coating of thickness 4 μm is formed on the glass substrate 301 having the Cu coating 302 and then treated with heat at 100° C. in the atmosphere for two hours.

In comparison sample #26, a parylene-C coating of thickness 2 μm is formed on the glass substrate 301 having the Cu coating 302, and then another parylene-C coating of thickness 2 μm is formed on the initial parylene-C coating.

In comparison sample #27, a parylene-N coating of thickness 2 μm is formed on the glass substrate 301 having the Cu coating 302, and then a parylene-N coating of thickness 2 μm is formed on the parylene-C coating.

In comparison sample #28, a parylene-C coating of thickness 2 μm is formed on the glass substrate 301 having the Cu coating 302, to be treated with heat at 120° C. in the atmosphere for two hours, and then a parylene-C coating of thickness 2 μm is formed on the initial parylene-C coating.

In comparison sample #29, a parylene-N coating of thickness 2 μm is formed on the glass substrate 301 having the Cu coating 302, to be treated with heat at 120° C. in the atmosphere for two hours, and then another parylene-N coating of thickness 2 μm is formed on the initial parylene-N coating.

In comparison sample #30, a parylene-C coating of thickness 2 μm is formed on the glass substrate 301 having the Cu coating 302, and then a parylene-N coating of thickness 2 μm is formed on the parylene-C coating.

In comparison sample #31, a parylene-N coating of thickness 2 μm is formed on the glass substrate 301 having the Cu coating 302, and then a parylene-C coating of thickness 2 μm is formed on the parylene-N coating.

In comparison sample #32, a parylene-N coating of thickness 2 μm is formed on the glass substrate 301 having the Cu coating 302, to be treated with heat at 120° C. in the atmosphere for two hours, and then a parylene-C coating of thickness 2 μm is formed on the parylene-N coating.

Etching caused by more than one pinhole is observed in the comparison samples #22 to #27 within 24 hours, in the samples #29, #31, and #32 within 120 hours, and in the samples #28 and #30 within 250 hours.

The samples #22 and #23 show that etching occurs in the parylene coatings within 24 hours if additional treatment is not performed to the coatings when they are formed and that such coatings do not display effective insulating properties in ink with a high electric conductivity.

The samples #24 and #25 show that heat treatment performed after the parylene coatings are formed is less effective in preventing etching caused by pinholes.

The samples #26 and #27 show that merely forming two layers of parylene coatings of total thickness 4 μm is less effective in preventing etching caused by pinholes.

In the samples #28 and #29, pinhole(s) is not observed until a lapse of 120 hours since heat treatment acts more effectively, if not sufficiently effectively, than in the samples #26 and #27. The fact indicates that even if the heat treatment is performed, merely forming two layers of the same kind of parylene coating is less effective in preventing the etching.

Pinholes are not observed in the sample #31 until a lapse of 120 hours, and in the sample 30 until a lapse of 250 hours. The results show that the two layers formed of two different kinds of parylene coatings of parylene C and parylene N are effective in preventing the etching.

In the sample #32, pinholes are not observed until a lapse of 250 hours. In comparison with the result of the sample #31, this result shows that the two layers of two different kinds of parylene coatings of parylene C and parylene N and the heat treatment of the parylene-N coating act effectively.

In the sample #21, no pinhole is observed after a lapse of 285 hours. This result shows that electrolytic corrosion of the Cu coating 302 caused by pinhole(s) is prevented by treating the parylene-C coating with heat at 120° C. in the atmosphere for two hours after the parylene-C coating is formed and then forming the parylene-N coating on the parylene-C coating, so that insulating properties of the parylene coatings are improved.

Figure 8A:
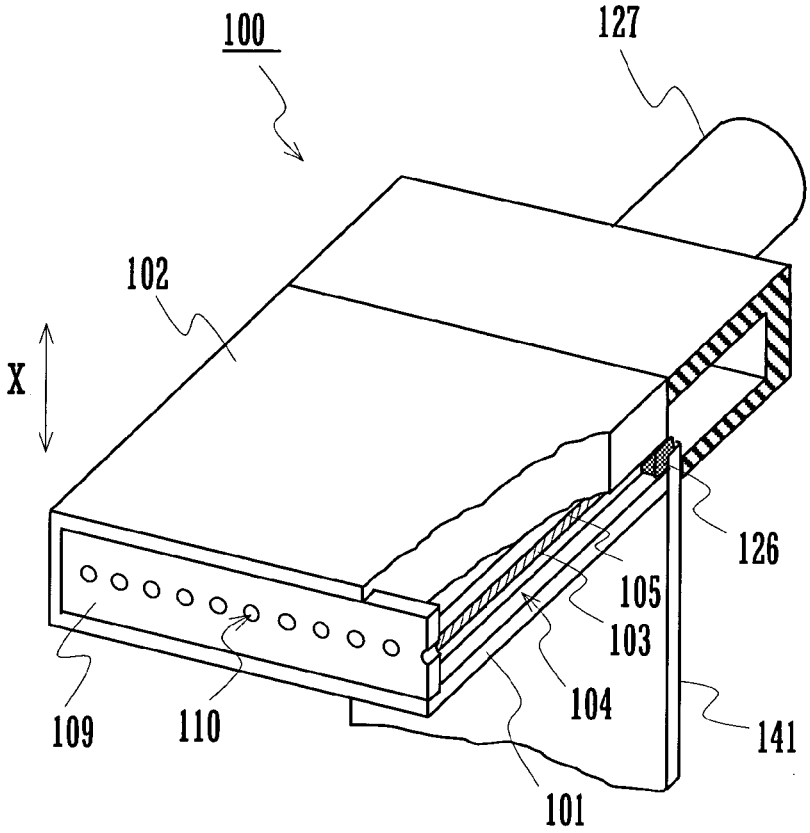
FIGS. 8A and 8B are respectively a partially cutaway, perspective view and a lateral cross-sectional view illustrating a schematic configuration of an ink-jet printhead according to an embodiment of the present invention.
Figure 8B:
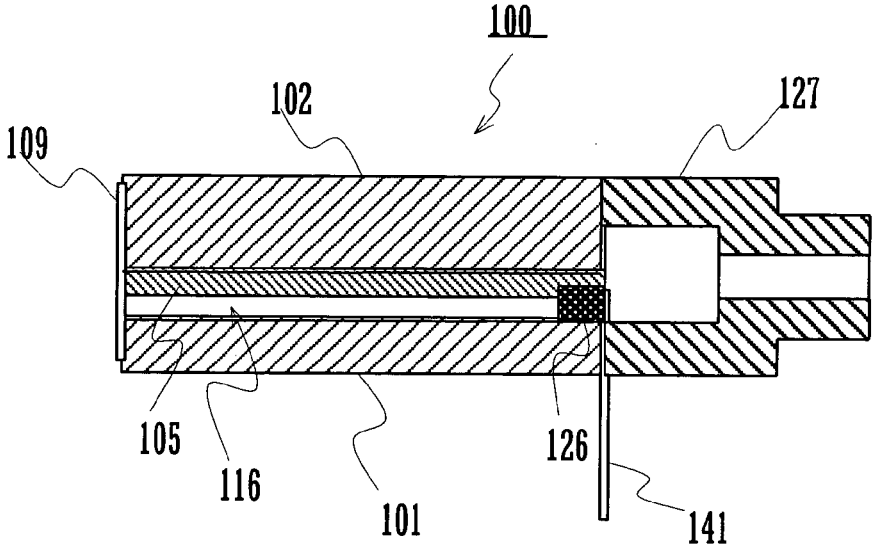

FIGS. 8A and 8B are respectively a partially cutaway, perspective view and a lateral cross-sectional view illustrating a schematic configuration of an ink-jet printhead according to the embodiment of the present invention. An ink-jet printhead 100 includes a base member 101, a cover member 102, a nozzle plate 109, and a substrate 141. The base member 101 is made of a PZT (lead zirconate titanate) ceramics material that is a piezoelectric material with high dielectric constant. The base member 101 is a plate of thickness approximately 1 mm poled in the direction of an arrow X in the drawing.

The base member 101 has a plurality of grooves 104 to serve as ink chambers cut therein by rotation of a diamond cutting wheel (dicing blade). The grooves 104 are formed with sidewalls 103 therebetween so as to be parallel to each other and all of the same depth. The grooves 104 are of depth about 300 μm, width about 70 μm, and pitch about 140 μm. Metal electrodes 105 are formed on upper surfaces, and upper-half portions of both side surfaces, of the sidewalls 103. Used for the electrodes 105 is metal such as aluminum, nickel, copper, or gold.

Metal electrodes formed on the upper surfaces of the sidewalls 103 concurrently with formation of the metal electrodes 105 on the upper-half portions of the both side surfaces of the sidewalls 103 are removed by lapping, or by lifting off resist coatings which are attached to cutting surfaces of the base member 101 before the grooves 104 are cut therein.

Figure 9:
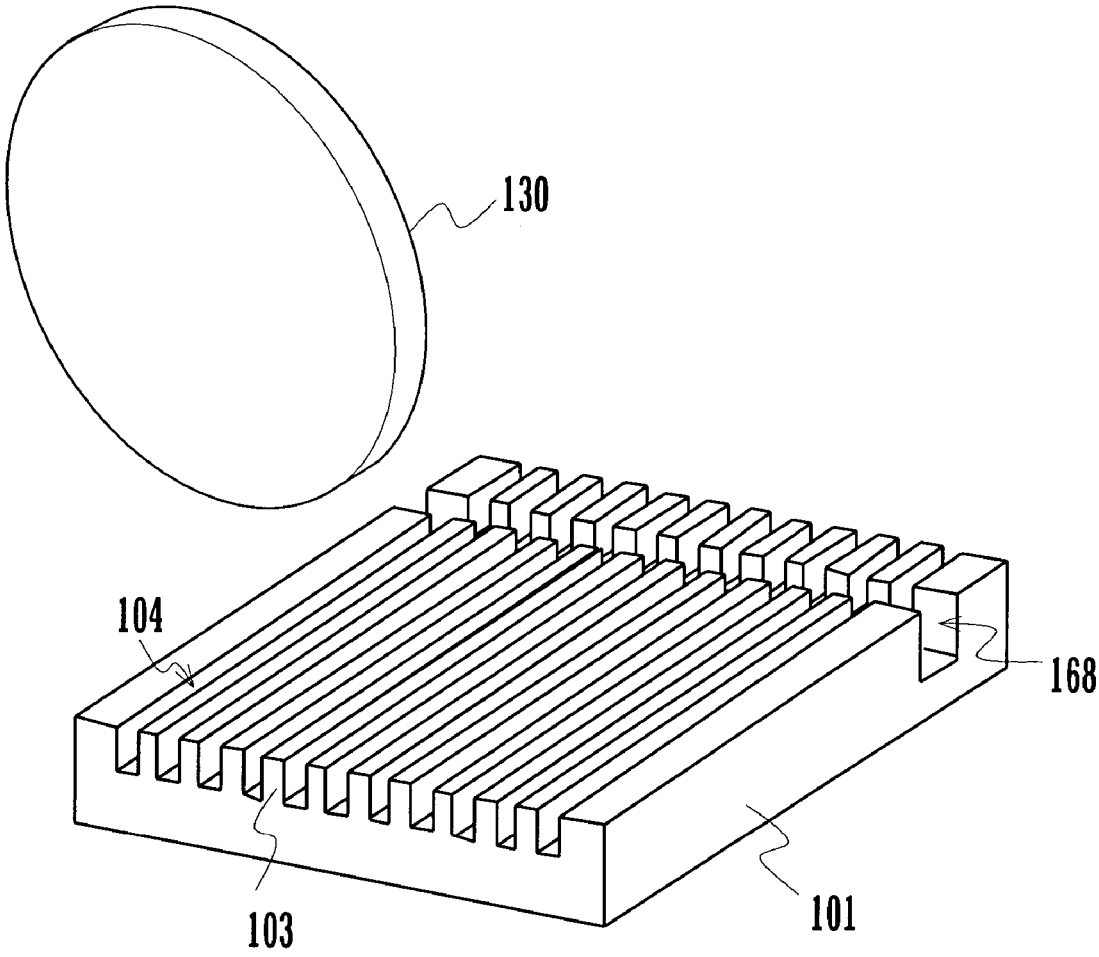
FIG. 9 is a perspective view illustrating part of a production process of the ink-jet printhead.
Figure 10A:
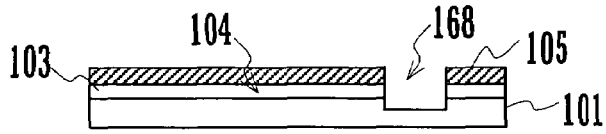
FIGS. 10A to 10G are diagrams illustrating the production process of the ink-jet printhead.
Figure 10B:
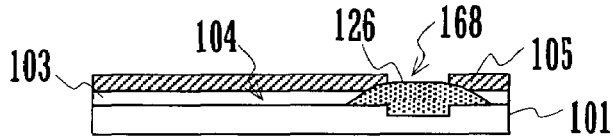

The base member 101 provided with the metal electrodes 105 has an applying groove 168 cut therein in a direction perpendicular to a direction of ink channels by rotation of a diamond cutting wheel 130, as shown in FIG. 9. The applying groove 168 is of depth about 300 μm and width about 500 μm. Illustrated in FIG. 10A is a longitudinal cross-sectional side view of one of the ink channels. As shown in FIG. 10B, conductive member 126 is applied to a level of 180 μm to the applying groove 168 through a dispenser (not shown).

The conductive member 126 is first poured into the applying groove 168 and then penetrates into the grooves 104 by the effect of capillary phenomenon. Thus the conductive member 126 is not applied to the upper surfaces of the sidewalls 103. When the conductive member 126 is solidified, accordingly, it is possible to bear down on a surface of the base member 101 on which the conductive member 126 is applied (hereinafter referred to as the applied surface), with a flat plate or the like so as to prevent the base member 101 from bending because of the solidification of the conductive member 126. Also, it is unnecessary to remove the conducting member 126 from the upper surfaces of the sidewalls 103 by lapping or the like. In a practical production process, a plurality of the dispensers is arranged above the applying groove 168.

Concurrently with bearing down on the applied surface of the base member 101 with a flat plate or the like, the conductive member 126 is heated with a device (not shown) to be solidified. Used as the conductive member 126 is gold, silver, or copper paste including epoxy resin components, or, gold or nickel plating solution.

Figure 10C:
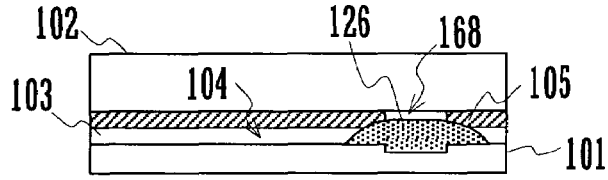
Figure 10D:
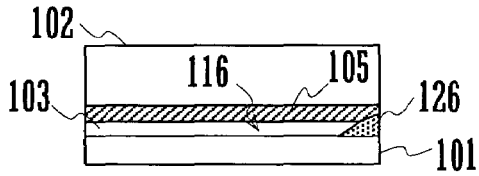

As illustrated in FIG. 10C, an upper surface of the base member 101 and a cover member 102 are joined with an adhesive such as an epoxy adhesive. As illustrated in FIG. 10D, the cover member 102 and the base member 101 is cut with a width wider than the width of the applying groove 168, so that the conductive member 126 is separated and isolated in each ink channel. With an upper space of the grooves 104 covered, the ink-jet printhead 100 now has a plurality of the ink chambers 116 with partitions therebetween in a sideways direction. Ink is filled in all the ink chambers 116 through a space above the conductive member 126.

The substrate 141 with conductor patterns respectively formed thereon at corresponding positions to those of the respective ink channels is connected to the conductive member 126 formed at an edge 115 of the base member 101. The substrate 141 and the conductive member 126 are joined with an anisotropic conductive adhesive, or connected by insertion of bumps formed on the conductor patterns into the conductive member 126.

Figure 10E:
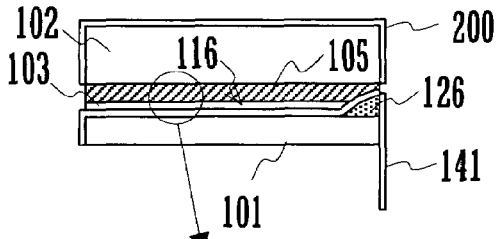

Next, as illustrated in FIG. 10E, the organic insulating coating 200 is formed in the ink-jet printhead 100. First in the formation, the first parylene coating 200 is formed to have a thickness of 2 μm. Since the parylene coating 201 is formed by CVD method at room temperature without heating the ink-jet printhead 100, there is a minimized risk of decreasing poling properties of the piezoelectric material constituting the base member 101 of the ink-jet printhead 100. Further, since the parylene coating 201 has good step coverage, the parylene coating 201 is effective for ensuring insulating properties in a portion having a complex-shaped surface such as the ink channels 116 in the ink-jet printhead 100. In the ink-jet printhead 100 according to the present embodiment, the first parylene coating 201 in the ink channels has a thickness of 1.7 μm or more.

After the parylene coating 201 is formed in the ink-jet printhead 100, heat treatment is performed to the printhead 100 in an oven at 100° C. for two hours. As described earlier, the base member 101 is made of the poled PZT. A temperature at which the PZT is depoled, namely the Curie temperature of the PZT (hereinafter referred to merely as the Curie temperature), is 250° C. and heating is normally allowed up to half the Curie temperature in Celsius scale. Therefore the heat treatment at 100° C. does not present any problem in producing the ink-jet printhead 100.

Figure 10F:
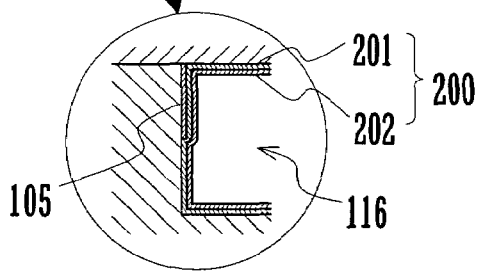

Then, the second parylene coating 202 is formed to have a thickness of 2 μm. In the ink-jet printhead 100 according to the present embodiment, the second parylene coating 202 in the ink channels has a thickness of 1.7 μm or more. As a result formed in the ink channels of the ink-jet printhead 100 is the organic insulating coating 200 of sample #1 as shown in FIG. 4, composed of the first parylene coating 201 and the second parylene coating 202, as illustrated in FIG. 10F, which is an enlarged cross-sectional view.

A surface of the second parylene coating 202 is now etched with a plasma processing device (not shown), so that polar groups are arranged on the surface, thereby improving affinity for water molecules of the parylene coating 202: the surface of the second parylene coating 202 is hydrophilized. When ink is filled in an ink-jet printhead having a complicated internal constitution as described later, accordingly, there is a reduced risk of air bubbles remaining on an inner coating surface and being trapped inside the ink-jet printhead. Air bubbles existing in an ink-jet printhead, by their expansion and contraction, decrease pressure fluctuation in the ink chambers to be used to eject ink, thereby causing the respective ink chambers to have varied ink-ejecting properties. In addition, since all the component parts are hydrophilized in the hydrophilizing process by the plasma processing, the etching of the surface of the parylene coating 202 is preferably performed prior to a nozzle-joining process so as not to decrease water-repellent properties of a water-repellent coating formed on nozzles. Furthermore, although in the present embodiment the plasma processing is used to hydrophilize the surface of the second parylene coating 202, the hydrophilizing process may be performed by an alternative method such as of applying hydrophilic resin.

Figure 10G:
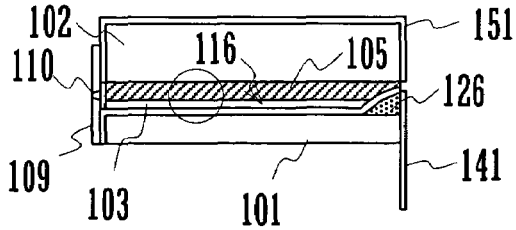
Figure 11:
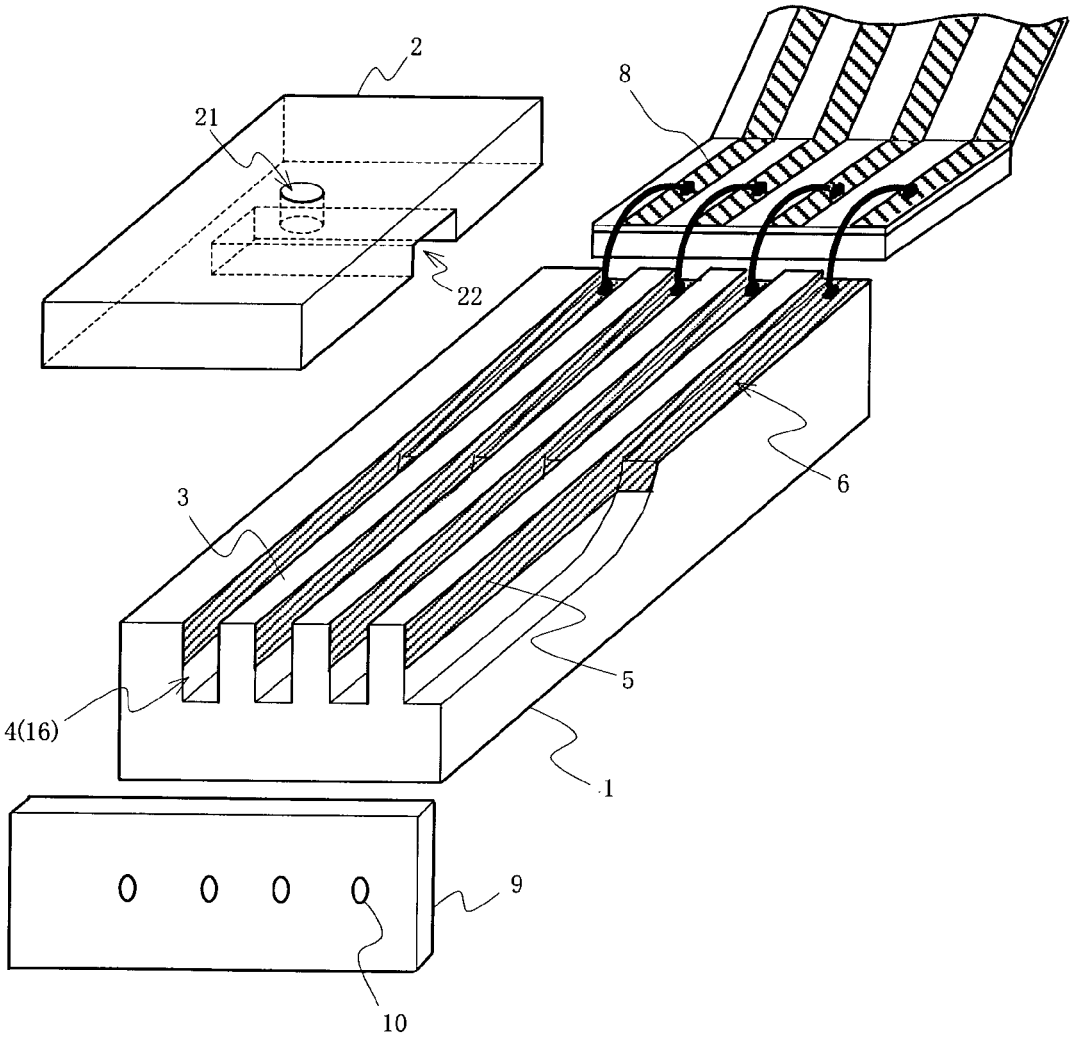
FIG. 11 PRIOR ART
FIG. 11 is a perspective view illustrating a configuration of a typical shear mode ink-jet printhead.

Next, as illustrated in FIG. 10G, the nozzle plate 109 provided with nozzle orifices 110 positioned correspondingly to the respective ink chambers 116 is joined onto front surfaces of the base member 101 and the cover member 102. Finally, a manifold 127 as shown in FIG. 8 is joined onto rear surfaces of the base member 101 and the cover member 102 with the substrate 141 between the manifold 127 and the rear surfaces. To improve reliability, joints may be sealed with resin so that ink does not leak from the joints.

With the arrangement as described above, in each of the ink chambers 116, the electrodes 105 which are respectively formed on two mutually-facing lateral surfaces of the two sidewalls 103 which form the instant ink chamber 116 are electrically connected to the conductive member 126. Therefore, a voltage, when applied to the conductive member 126, is applied through the conductive member 126 simultaneously to the electrodes 105 formed on the two mutually-facing lateral surfaces. At the same time the sidewalls 103 serving as the two lateral surfaces of the instant ink chamber 116 are deformed toward the interior of the ink chamber 116, such that ink droplets are ejected through the nozzle orifices 110.

Formed as samples for comparison purpose are: an ink-jet printhead 100' (not shown) using an organic insulating coating having a similar constitution to that of the comparison sample #2 as shown in FIG. 4; and an ink-jet printhead 100" using an organic insulating coating having a similar constitution to that of the comparison sample #13 as shown in FIG. 6. More specifically, in a production process of the ink-jet printhead 100', an organic insulating coating 200' of thickness 4 μm whose main constituent is parylene is formed as a protective coating of electrodes; and in a production process of the ink-jet printhead 100" a first parylene coating is formed, then heat treatment is performed at 150° C. in the atmosphere for two hours, and a second parylene coating is subsequently formed. The ink-jet printheads 100' and 100" as comparison samples are identical in configuration to the ink-jet printhead 100 of the present embodiment, except for the constitutions of their organic insulating coatings. The numbers of ink chambers provided in the ink-jet printheads 100, 100' and 100" are all 120.

On these ink-jet printheads 100, 100', and 100", durability tests are conducted by continuous ink ejecting. In the tests, an ink of conductivity 19.85 S/m is used and the continuous ink-ejecting operation is performed by inputting a drive signal of voltage 30 V and frequency 120 kHz. After $10^{12}$ times of ink ejection, change in ink ejection speed, and the number of ink chambers that do not eject ink are examined in each of the ink-jet printheads.

The test results are as follows. In the ink-jet printhead 100, although the ink ejection speed decreases in all the ink chambers by three percent with respect to its initial speed value, there are no ink chambers observed that show a decrease in the ink ejection speed by more than 10 percent, or that do not eject ink. In the ink-jet printhead 100', however, the ink ejection speed decreases by more than ten percent in 17 ink chambers, and two ink chambers do not eject ink. In the ink-jet printhead 100", the ink ejection speed already decreases by more than 10 percent in 23 ink chambers when the durability test starts.

These results show that although the heat treatment to the first parylene coating is necessary for stable ink ejection, the treatment, when performed at a temperature (150° C.) beyond half the Curie temperature (125° C.), has a negative effect of the PZT being depoled, thereby preventing the stable ink ejection. Therefore, the experimental results as shown in FIG. 6 also considered, an optical temperature range for the heat treatment to the first parylene coating shall be between its glass transition point (87–97° C.) and half the Curie temperature (125° C.) in the ink-jet printhead of the present embodiment.

In the foregoing embodiment the organic insulating coating 200 includes the two layers of parylene coatings. However, it goes without saying that the more the number of parylene coating layers, and the more the number of times the heat treatment is performed between the parylene coating layers, the higher insulating properties to be obtained become. The organic insulating coating may include more than three layers of parylene coatings.

Although a piezoelectric ink-jet printhead is described in the foregoing embodiment, the present invention is not limited to the specific embodiment as described above, but is applicable to electrostatic or thermal ink-jet printheads for which insulation between electrical circuit parts and ink is required. The present invention is also applicable to other semiconductor parts which are required to remain insulated from an electrolyte solution.

According to the present invention the following advantages can be obtained.

The organic insulating coating includes at least two layers of the first organic coating formed on the substrate and the second organic coating formed on the first coating. At least either one of the first and second organic coatings is treated with heat, such that occurrence of pinholes is prevented in at least either one of the two organic coatings. Thus the insulating properties of the organic insulating coating are improved.

At least either one of the first and second organic coatings is treated with heat at a temperature between its glass transition point and its melting point, such that at least either one of the two layered organic coatings become a uniform, flawless coating with insulating properties, thereby preventing the occurrence of pinholes. Thus the insulating coating is improved.

At least either one of the first and second organic coatings is treated with heat at a temperature between its glass transition point and half the Curie temperature. Consequently, even if a substrate on which the coatings are formed has piezoelectric properties, the piezoelectric properties are not impaired by the heat treatment and thus the substrate can be used without a problem.

The heat treatment to the organic coating, performed in the atmosphere, can be performed in a normal environment. Consequently a device for providing a particular environment is unnecessary, and thereby production costs can be reduced.

At least two layers of the organic coatings are formed by the deposition of organic materials. As a result a device for performing such a process as an electrodeposition process is unnecessary, and thereby production costs can be reduced.

The protective coat for the electrodes in the ink chambers of the ink-jet printhead includes two and more layers of the organic coatings with at least one of the layer treated with heat. This ensures that the electrodes formed in the ink chambers to be filled with ink are insulated from the ink by the organic coating that has improved insulating properties with occurrence of pinholes prevented therein, thereby allowing stable ink ejection to be maintained.

The protective coat for the electrodes in the ink chambers of the ink-jet printhead is formed of an organic coating including mainly poly-p-xylylene. This ensures that the electrodes formed in the ink chambers to be filled with ink are insulated from the ink by the organic coating that is chemically stable and less susceptible to damage in an environment where the coating is exposed. Also, since the poly-p-xylylene coating can be formed at room temperature by vapor phase epitaxy, it is possible to form an uniform protective coating of the poly-p-xylylene over a substrate whose properties are degraded at high temperatures or whose surface has a complex shape, without thermally damaging the substrate.

The protective coat for the electrodes in the ink chambers of the ink-jet printhead is formed of an organic coating including mainly parylene C that has gas impermeability for preventing permeation of gases including water vapor. This ensures that the electrodes remain insulated from the ink without deterioration of the protective coat even when the ink in the ink channels is vaporized by heat or when air is in the ink channels.

The protective coat for the electrodes in the ink chambers of the ink-jet printhead is formed of: an organic coating including mainly parylene C that has high gas impermeability for preventing permeation of gases including water vapor; and an organic coating including mainly parylene N that has high water resistance. This ensures that the electrodes remain insulated from aqueous ink without deterioration of the protective coat even when the ink in the ink channels is vaporized by heat or when air is in the ink channels.

The protective coat for the electrodes in the ink chambers of the ink-jet printhead is formed of two layers of organic coatings: an organic coating in contact with the electrodes, including mainly parylene C that has high gas impermeability for preventing permeation of gases including water vapor; and an organic coating in contact with ink, including mainly parylene N that has high water resistance. This allows the electrodes to be protected from aqueous ink by the organic coating with high water resistance and from vaporized ink or air mixed in ink by the organic coating with high gas (including water vapor) impermeability.

Of the two layers of organic coatings forming the protective coating for the electrodes in the ink chambers of the ink-jet printhead, the upper-layer coating, namely the second organic coating, has a hydrophilized surface. This ensures a smooth flow of aqueous ink into the ink chambers by contact with the hydrophilic organic coating.

What is claimed is:

1. An ink-jet printhead comprising:

electrodes provided on at least part of interior walls of ink chambers, at least part of the ink chambers made of a piezoelectric material; and a protective coating for coating the surfaces of the electrodes, the protective coating formed by:

a first coating step of forming a first organic coating on the interior walls of the ink chambers provided with the electrodes;

a second coating step of forming a second organic coating on the first organic coating; and at least either one of:

a first heat treatment step of treating the first organic coating with heat after the first coating step; and a second heat treatment step of treating the second organic coating with heat after the second coating step, wherein at least one of the first heat treatment step and the second heat treatment step comprises heating said first or second organic coating for a period of time at a temperature that is greater than a glass transition temperature of said first or second organic coating and less than a melting point of said first or second organic coating.

2. The ink-jet printhead according to claim 1, wherein the first and second organic coatings comprise mainly poly-p-xylylene.

3. The ink-jet printhead according to claim 1, wherein the first and second organic coatings comprise mainly poly-monochloro-p-xylylene.

4. The ink-jet printhead according to claim 1, wherein either one of the first and second organic coatings comprises mainly poly-p-xylylene and the other comprises mainly poly-monochloro-p-xylylene.

5. The ink-jet printhead according to claim 1, wherein the first organic coating comprises mainly poly-monochloro-p-xylylene and the second organic coating comprises mainly poly-p-xylylene.

6. The ink-jet printhead according to claim 1, wherein the second organic coating comprises mainly poly-p-xylylene and a surface thereof is hydrophilized.

7. The ink-jet printhead according to claim 1, wherein the piezoelectric material comprises an organic material with a high dielectric constant.

8. The ink-jet printhead according to claim 1, wherein the electrodes are provided only on that portion of said at least part of interior walls of ink chambers that corresponds to the second coating.

9. The ink-jet printhead according to claim 1, wherein the period of time is about two hours.

10. The ink-jet printhead according to claim 1, wherein the first organic coating is heated at a temperature between about 100 degrees Centigrade and about 150 degrees Centigrade and the second organic coating is heated at a temperature between about 100 degrees Centigrade and about 150 degrees Centigrade.

11. The ink-jet printhead according to claim 1, wherein the glass transition temperature of said first or second organic coating is between about 87 and about 97 degrees Centigrade, and wherein the melting point of said first or second organic coating is about 250 degrees Centigrade.

12. An ink-jet printhead comprising:

one or more ink chambers for providing ink, each of the one or more ink chambers having a base portion, a cover portion, and a pair of opposing side walls;

a plurality of electrodes provided on at least some portion of each of the pair of opposing side walls of ink chambers;

a conductive member that is structured and arranged in each of the one or more ink chambers so that each of said one or more ink chambers includes a conductive portion that is isolated from a conductive portion in an adjacent ink chamber; and a first protective coating provided on a lower portion of pair of opposing side walls;

a second protective coating provided on an upper portion of pair of opposing side walls;

wherein one or both of the protective coatings is provided with a heat treatment comprising heating one or both of the protective coatings for a period of time at a temperature that is greater than a glass transition temperature of said first or second organic coating and less than a melting point of said first or second organic coating after the coating has been applied.

13. The ink-jet printhead according to claim 12, wherein the pair of electrodes is only provided on the upper portion of each of the pair of opposing side walls.

14. The ink-jet printhead according to claim 12, wherein the pair of electrodes is provided on the upper portion and only a small portion of the lower portion of the pair of opposing side walls.

15. The ink-jet printhead according to claim 12, wherein each of the protective coatings comprises an organic insulating coating.

16. The ink-jet printhead according to claim 12, wherein the glass transition temperature of said first or second organic coating is between about 87 and about 97 degrees Centigrade, and wherein the melting point of said first or second organic coating is about 250 degrees Centigrade.

* * * * *